US009834945B2

(12) United States Patent
Crumley

(10) Patent No.: US 9,834,945 B2
(45) Date of Patent: Dec. 5, 2017

(54) CONCRETE FORM TIE ASSEMBLY FOR MONOLITHIC SLABS BEARING ON MASONRY STEM WALLS

(71) Applicant: Harvel K. Crumley, Jacksonville Beach, FL (US)

(72) Inventor: Harvel K. Crumley, Jacksonville Beach, FL (US)

( * ) Notice: Subject to any disclaimer, the term of this patent is extended or adjusted under 35 U.S.C. 154(b) by 166 days.

(21) Appl. No.: 14/734,551

(22) Filed: Jun. 9, 2015

(65) Prior Publication Data

US 2015/0354235 A1 Dec. 10, 2015

Related U.S. Application Data

(60) Provisional application No. 62/010,326, filed on Jun. 10, 2014.

(51) Int. Cl.
*E04G 11/36* (2006.01)
*E04C 5/16* (2006.01)

(52) U.S. Cl.
CPC ..... *E04G 11/365* (2013.01); *E04C 5/168* (2013.01)

(58) Field of Classification Search
CPC ..... E04C 5/168; E04G 11/365
USPC ..... 52/250, 699, 700, 701; 249/19, 214, 218
See application file for complete search history.

(56) References Cited

U.S. PATENT DOCUMENTS 1,190,977 A 7/1916 Bartow
1,597,424 A * 8/1926 Bennetts ..... E04G 17/06 249/191
1,828,618 A 10/1931 Pieters
1,943,361 A * 1/1934 Awbrey ..... E04G 17/0721 249/214
3,246,869 A * 4/1966 Bowden ..... E04G 17/0721 249/214
3,341,998 A 9/1967 Lucas
3,625,470 A * 12/1971 Shoemaker ..... E04G 17/0721 249/214

(Continued)

FOREIGN PATENT DOCUMENTS

CH 603953 A5 * 8/1978 ..... E04C 5/168
DE FR 2585751 A1 * 2/1987 ..... E04G 11/365

(Continued)

OTHER PUBLICATIONS

Translation of Description for FR 3 011 866 to Croizier (filed Oct. 2013).*

*Primary Examiner* — Michael Safavi
(74) *Attorney, Agent, or Firm* — Stephen E. Kelly; Hill Ward Henderson, P.A.

(57) ABSTRACT

A tie assembly for use during construction of monolithic cast-in-place concrete floor slabs bearing on a masonry stem wall. The tie assembly connects to one or more header blocks of the stem wall, and the tie assembly is configured to retain a concrete form member in place during the pour and curing period of the cast-in-place concrete. The tie assembly has a removable tab member with one or more slots for receiving a wedge stake, which braces the form member against lateral forces caused by the wet concrete. A mechanical fastener is driven through an upper portion of the wedge stake and concrete form, and the insertion tip of the mechanical fastener connects to a reinforcement holder for retaining a reinforcing member in place.

15 Claims, 7 Drawing Sheets

(56) References Cited

U.S. PATENT DOCUMENTS

| | | | | | |
|---|---|---|---|---|---|
| 3,904,717 | A * | 9/1975 | Stegmeier | E04H 4/141 | 249/19 |
| 3,964,219 | A * | 6/1976 | Hala | E04G 15/061 | 249/93 |
| 3,987,997 | A * | 10/1976 | Stegmeier | E04H 4/141 | 249/19 |
| 4,052,031 | A | 10/1977 | Melfi | | |
| 4,907,385 | A * | 3/1990 | Biodrowski | E02D 31/02 | 405/45 |
| 6,023,902 | A * | 2/2000 | So | E04C 5/06 | 249/214 |
| 6,058,672 | A | 5/2000 | McClellan | | |
| 6,857,240 | B1 | 2/2005 | MacAlister | | |
| 6,928,783 | B2 * | 8/2005 | Oliver | E02D 5/801 | 52/149 |
| 7,171,788 | B2 | 2/2007 | Bronner | | |
| 8,074,958 | B1 * | 12/2011 | Hoy | E04G 13/04 | 249/19 |
| 8,458,973 | B1 * | 6/2013 | Powers, Jr. | E04C 3/20 | 249/19 |
| 8,516,768 | B2 | 8/2013 | Johnson, III | | |
| 8,635,828 | B2 | 1/2014 | Bahnmiller | | |
| 2004/0094689 | A1 * | 5/2004 | Rose | E04G 17/001 | 249/6 |
| 2013/0008112 | A1 | 1/2013 | Studebaker et al. | | |

FOREIGN PATENT DOCUMENTS

| | | | | |
|---|---|---|---|---|
| DE | 3618261 | A1 * | 12/1987 | E04G 11/365 |
| DE | 9406863 | U1 * | 6/1994 | E04G 11/365 |
| FR | 2939821 | * | 6/2010 | E04G 17/16 |
| FR | 3011866 | * | 4/2015 | E04G 17/16 |
| WO | 2009/147427 | A2 | 12/2009 | |
| WO | 2012/063074 | A2 | 5/2012 | |

* cited by examiner

CONCRETE FORM TIE ASSEMBLY FOR MONOLITHIC SLABS BEARING ON MASONRY STEM WALLS

CROSS-REFERENCE TO RELATED APPLICATION

Pursuant to 35 U.S.C. §119(e), this application claims the benefit of U.S. Provisional Patent Application Ser. No. 62/010,326, filed on Jun. 10, 2014, the entire contents of which are incorporated herein by this reference.

BACKGROUND (1) Technical Field

This invention relates generally to concrete form brackets, and more particularly to tie assemblies for the forms of monolithic concrete floor slabs bearing on masonry stem walls.

(2) Background

A common residential construction method involves the construction of a monolithic concrete floor slab that is supported by, and bears upon, masonry stem walls. The stem walls are made of masonry units, such as concrete blocks having two voids in them. In past construction methods, bracket members were inadequate to place the concrete forms in a substantially co-planar orientation with respect to the exterior face of the stem walls. Thus, the bearing area of the floor slab did not extend across the entire top surface of the stem walls. This configuration can cause instability or a weakened interface between the stem wall, floor slab, and even the structural wall bearing on the floor slab.

Another prior construction technique called for notched header blocks, where the notch was sized to receive the monolithic floor slab. This notching is an extra construction step and adds complexity to the construction process. The notched header blocks are non-standard, and they must be aligned properly to accommodate construction of the stem wall and floor slab interface. These extra steps are time consuming, and the extra materials can be expensive.

The present tie assembly promotes efficient construction of the monolithic slab and the use of standard masonry blocks by providing a structure to hold and retain concrete form members in place without requiring non-standard notching or other alternation of the header blocks or masonry stem walls.

SUMMARY OF THE PREFERRED EMBODIMENTS

The tie assembly disclosed herein is used to brace the forms used during construction of monolithic cast-in-place concrete floor slabs bearing on one or more masonry stem walls. Generally, the tie assembly comprises a retaining member, an extension member, and a slotted tab member. One embodiment of the retaining member comprises a shank connected to a bend. The retaining member is connected to the tab member by the extension member. The tab member is attached to the extension member at or near the end of the extension member opposite the end near which the retaining member is attached. The tab member comprises a slot configured to receive and removably retain a wedge stake, which braces the form member. The interface between the extension member and the tab member comprises a release mechanism for disconnecting the tab member from the extension member.

In use, the bend of the retaining member is placed under the header block, and the extension member extends across the top of the header block such that the tab member is cantilevered past the exterior face of the stem wall. The form member is seated on the cantilevered tab member. The wedge stake is then inserted into the slot, and the wedging action causes the wedge stake to firmly brace the form member against the lateral forces caused by the wet concrete of the floor slab.

A mechanical fastener is then driven through the wedge stake and through the form member to protrude from the interior face of the form member. Reinforcing members are connected to the protruding ends of the mechanical fasteners, and they act as the edge reinforcing of the floor slab.

After the concrete is cured, the mechanical fasteners are removed, the wedge stakes are removed, and the form members are stripped from the floor slab. The tabs are removed by striking the tabs with an impact force, which causes the tie assembly to fracture at the release mechanism.

Another embodiment of the retaining member further comprises a lip connected to the bend at a location distal from the connection point of the shank, such that the gap between the shank and the lip forms a throat. The throat is sized such that an outside wall of the header block is snugly seated in the throat. In this configuration, the lip provides a greater anchoring force against pullout or uplift caused by the forces acting on the tie assembly.

DETAILED DESCRIPTION OF THE PREFERRED EMBODIMENTS

Figure 1:
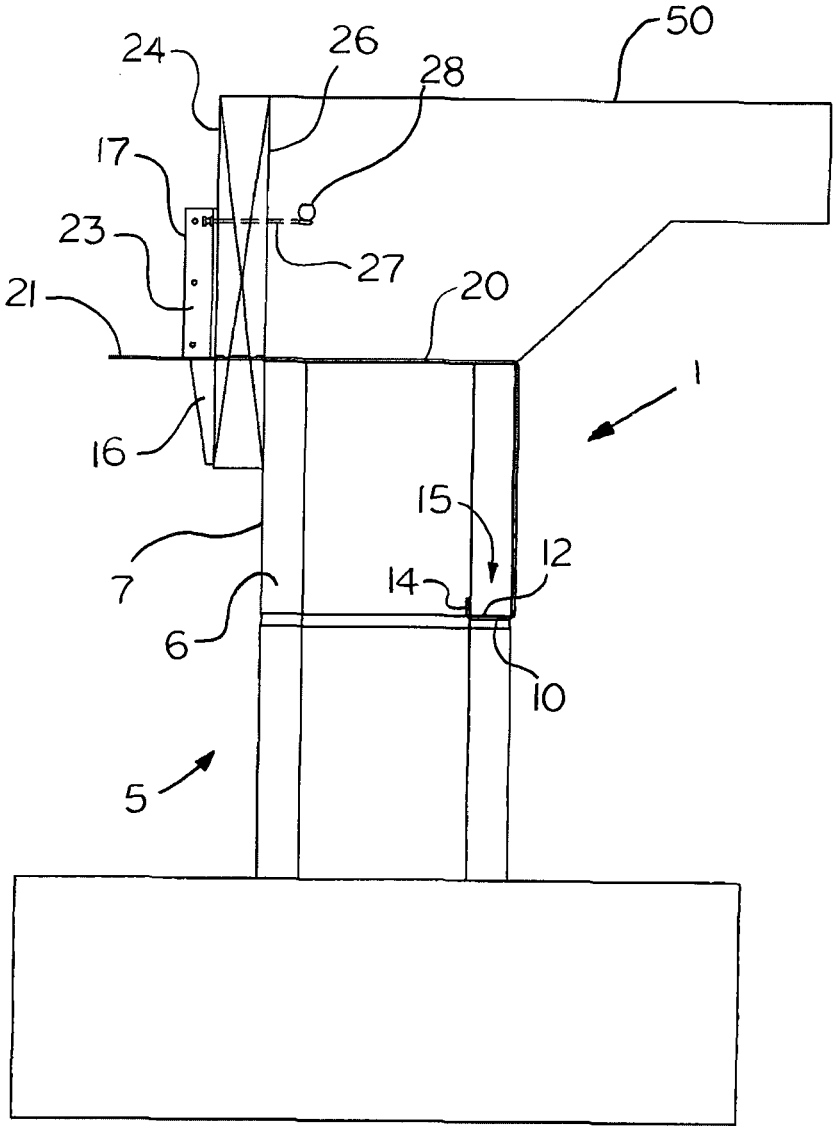
FIG. 1 is a cross section of a typical interface between a masonry stem wall and a monolithic slab, showing placement of an embodiment of the tie assembly having tab with a single slot.

With reference to the drawings, the tie assembly will now be described with regard for the best mode and the preferred embodiments. In general, the tie assembly disclosed herein is a retaining tie assembly intended for connecting masonry stem walls to the forms for cast-in-place concrete floor slabs. The embodiments disclosed herein are meant for illustration and not limitation of the invention. An ordinary practitioner will appreciate that it is possible to create variations of the following embodiments without undue experimentation.

Referring to FIGS. 1-4, the tie assembly 1 disclosed herein is used during construction of cast-in-place concrete monolithic floor slabs 50 bearing on one or more masonry stem walls 5. In one embodiment, the tie assembly 1 connects to one or more header blocks 6 on the stem wall 5, and the tie assembly 1 is configured to retain a form member 24 in place during the pour and curing period of the cast-in-place concrete.

Generally, the tie assembly 1 comprises a retaining member 10, an extension member 20, and a slotted tab 21. Referring to FIGS. 5-8, the retaining member 10 is any hook, bend, or other anchor member for retaining the tie assembly 1 in place and securely anchored to the stem wall 5. One embodiment of the retaining member 10 comprises a shank 11 connected to a bend 12. In one embodiment of the bend 12, the bend 12 further comprises an aperture 18 that allows grout or mortar to pass through the bend 12. Once cured, this grout or mortar provides additional resistance force to pullout of the retaining member 10. The extension member 20 is an elongate member having a first end and a second end. The extension member 20 is sized to span between the retaining member 10 and the tab 21, thus providing structural support between the retaining member 10 and the tab 21. The retaining member 10 is attached to the first end of the extension member 20. The tab 21 is attached to the second end of the extension member 20 via the release mechanism 25, as described below. The tab 21 further comprises one or more slots 22 configured to receive and removably retain a wedge stake 23 that braces the form member 24. The wedge stake 23 has a lower portion 16 in the form of a wedge, and an upper portion 17 configured to abut against and retain the concrete form member 24.

Referring again to FIGS. 1-4, the bend 12 of the retaining member 10 is placed under the header block 6 or otherwise attached to the stem wall 5, and the shank 11 is oriented vertically and parallel to the side of the header block 6. The extension member 20 extends across the top of the header block 6 such that the tab 21 is cantilevered past the exterior face 7 of the stem wall 5. The form member 24 is typically a timber plank having a cross section measuring two inches by twelve inches, or some other similar member. In one embodiment, the form member 24 is seated on the cantilevered tab 21. The lower portion 16 of the wedge stake 23 is then inserted into the slot 22, and the wedging action causes the upper portion 17 of the wedge stake 23 to firmly brace the form member 24 against the lateral forces caused by the wet concrete of the floor slab 50 that press hydrostatically against the form member 24. The position of the form member 24 is adjusted such that the interior face 26 of the form member 24 is substantially co-planar with the exterior face 7 of the stem wall 5. The interior face 26 of the form member 24 may even overlap with and abut against the exterior face 7 of the stem wall 5. In another embodiment, shown in FIG. 4, the form member 24 comprises one or more form slots 29 configured to receive the tab 21 and release mechanism 24 such that at least one slot 22 in the tab 21 protrudes past the outer face of the form member 24 to a sufficient distance to receive the wedge stake 23. In this embodiment, it is the form slot 29, rather than the bottom of the form member 24, that is seated on the extension member 20, on the tab 21, or on both. The bottom of the form member 24 extends below the tab 21 along the exterior face 7 of the stem wall 5.

The lateral force of the form member 24 is resisted by the wedge stake 23. This lateral force is caused by the hydrostatic pressure of the wet cast-in-place concrete of the floor slab 50. As a result, an axial force is developed in the tab 21, and that axial force is transferred across the release mechanism 25, into the extension member 20, and ultimately resisted by the retaining member 10.

Figure 2:
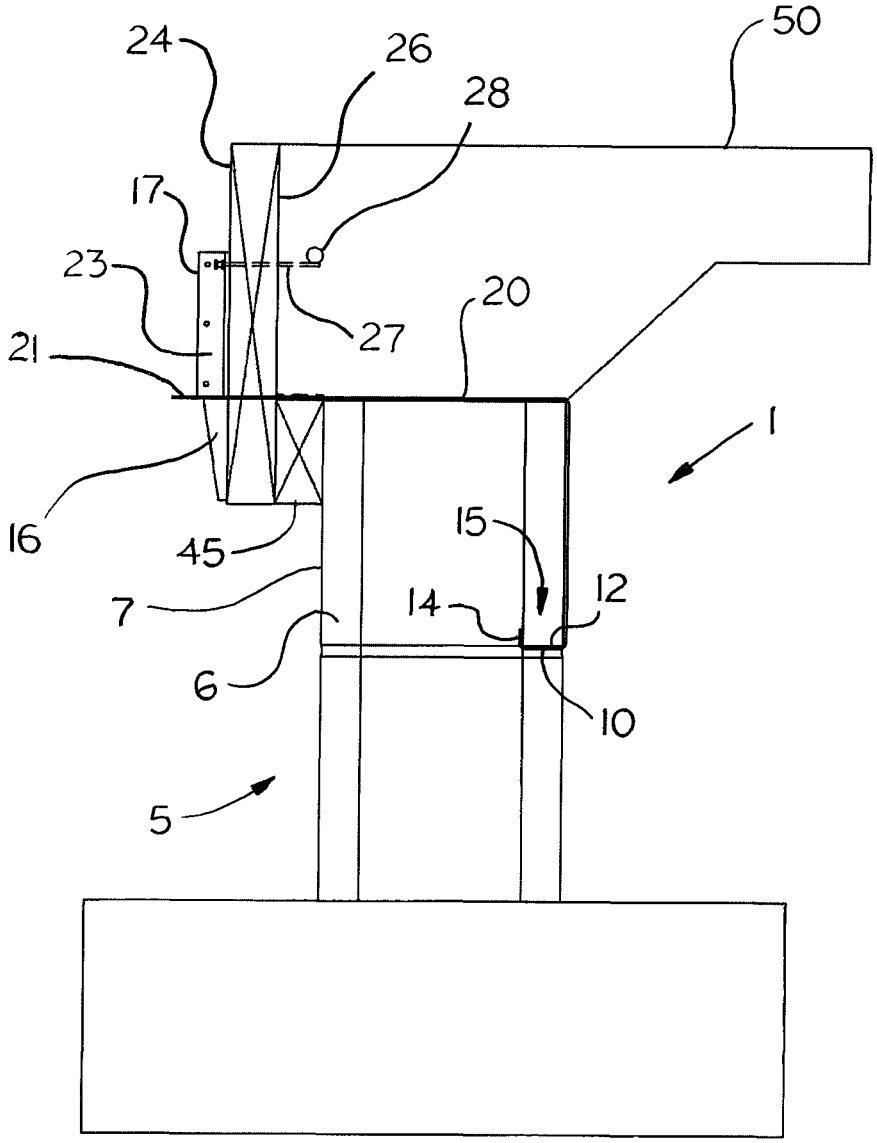
FIG. 2 is a cross section of a typical interface between a masonry stem wall and a monolithic slab, showing a form spacer and showing the placement of an embodiment of the tie assembly having tab with two slots.
Figure 3:
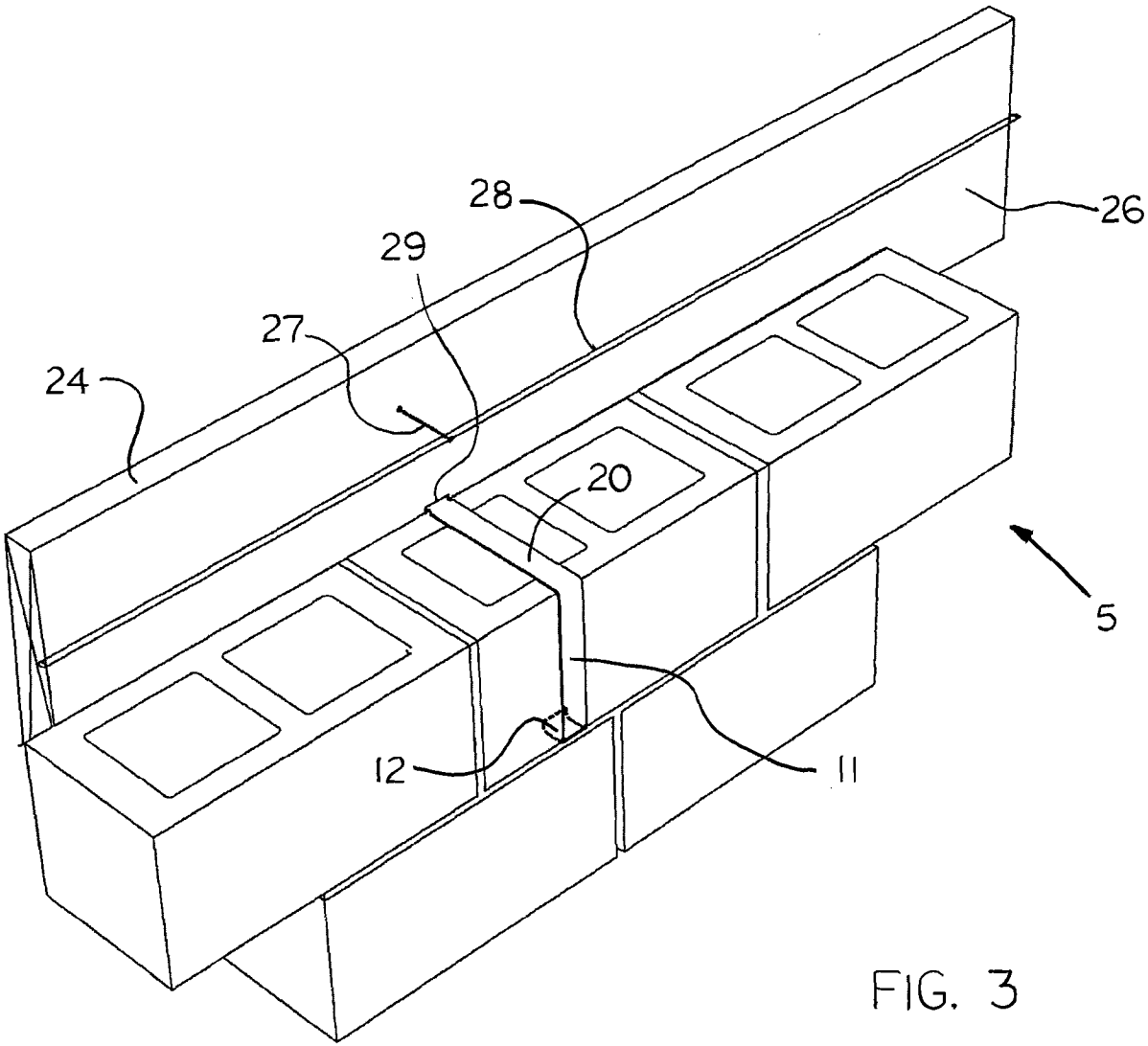
FIG. 3 is an isometric view of a section of a stem wall, showing the tie assembly installed.
Figure 4:
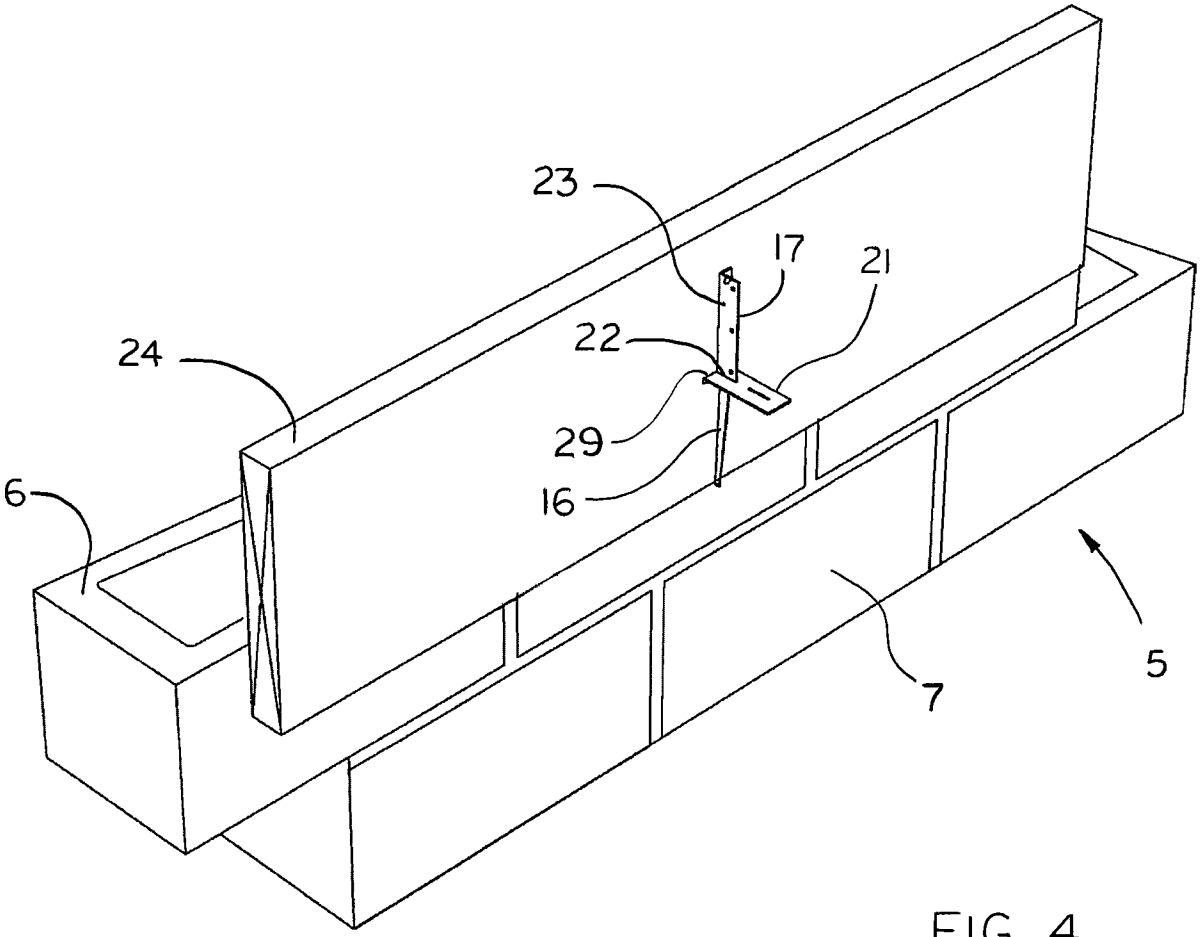
FIG. 4 is an isometric view of a section of a stem wall, showing the wedge stake installed into the tab member of the tie assembly.
Figure 8:
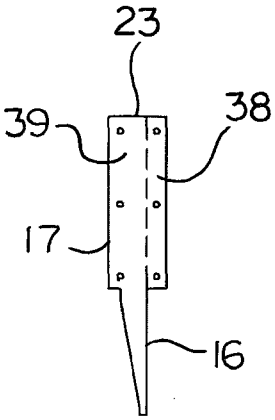
FIG. 8 is a side view of one embodiment of the wedge stake.

In one embodiment of the tie assembly 1, shown in FIG. 2, the tie assembly 1 is configured for use with a concrete form spacer 45. The form spacer 45 is used in application where it is desirable for the slab 50 to overhang the exterior face 7 of the stem wall 5, such as at the interface between a house and a wooden deck. To accommodate the form spacer 45, the tab 21 has a second slot 22 for receiving a wedge stake 23. In this embodiment of the tab 21, shown in FIG. 5, the first slot **22*a* is disposed in the tab 21 at a location closer to the release mechanism 25 than the location of the second slot 22*b*. Once the tie assembly 1, the form spacer 45 and the form member 24 are placed at the top of the stem wall 5 as desired, the wedge stake 24 is inserted into the second slot 22*b* to retain the form member 24 in fixed relation to the form spacer 45 and the stem wall 5**.

Figure 9:
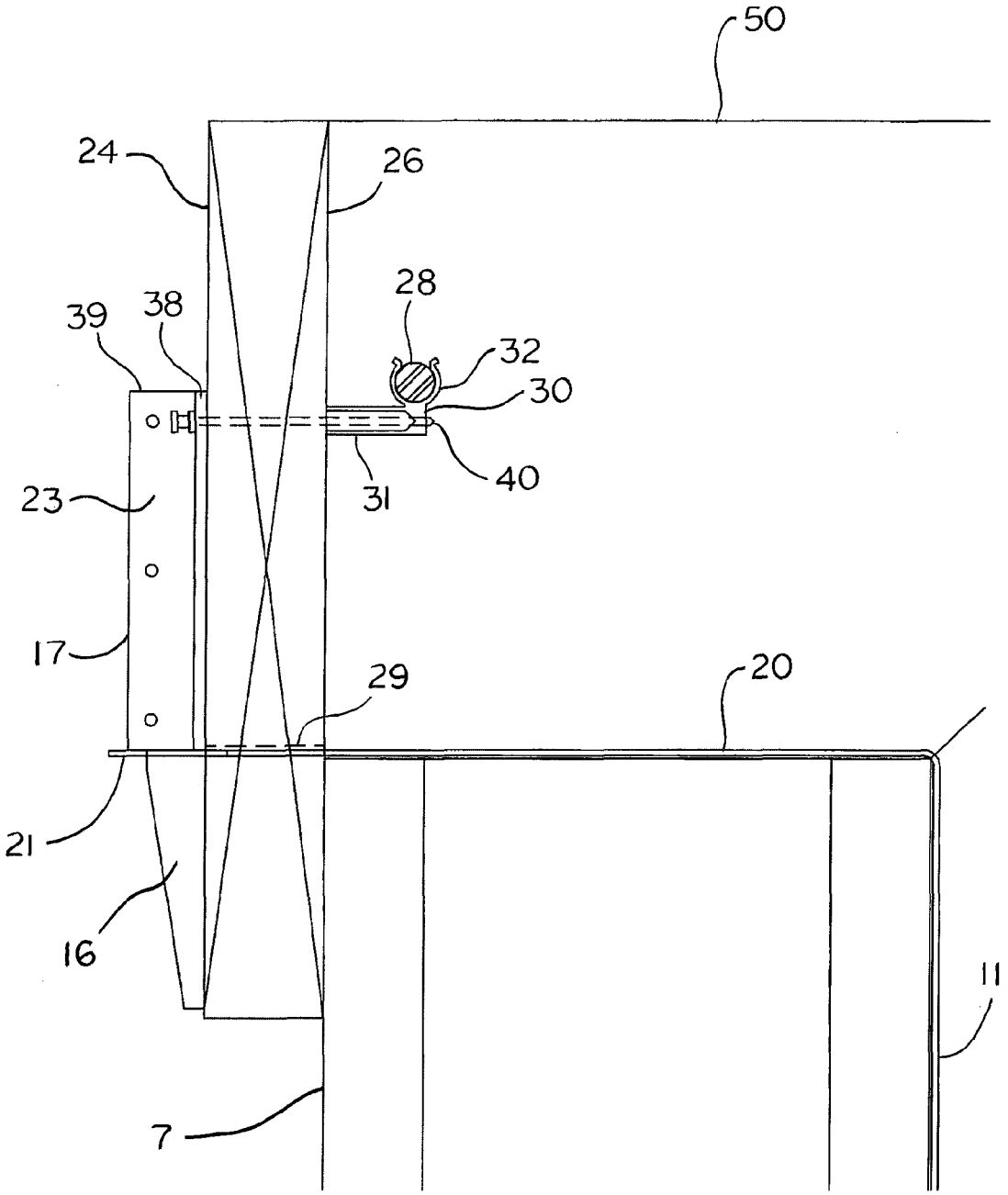
FIG. 9 is a partial cross section view of the stem wall interface with the monolithic slab, where the tie assembly comprises a reinforcement holder.

In one embodiment, shown in FIG. 9, the wedge stake 23 has a planar, wedge-like lower portion 16 and an upper portion 17 having a flange 38 and a web 39. The flange 38 is placed flat against the outside surface of the form member 24, and the web 39 resists the bending force caused by the lateral force of the form member 24. A mechanical fastener 27 is inserted through the flange 38 and through the form member 24 so that the tip 40 of the mechanical fastener 27 protrudes from the interior face 26 of the form member 24. The mechanical fastener 27 is a smooth shank duplex nail, a screw, or other similar member. Reinforcing members 28, such as reinforcing steel or carbon fiber bars, are connected to the protruding ends of the mechanical fasteners 27. In other embodiments, reinforcing members 28 could also be wire mesh or other types of structural reinforcement capable of reinforcing cast-in-place concrete against tension cracking. In most instances, the reinforcing members 28 will act as the edge reinforcing of the floor slab 50.

After the tie assembly 1 is placed, the form members 24 are secured, and the reinforcing members 28 are installed. The wet concrete is then poured, typically in a monolithic pour, to form the floor slab 50. After the concrete is cured, the mechanical fasteners 27 are removed, and the wedge stakes 23 are removed by pulling them upward and out of the respective slots 22 in the tabs 21. The form members 24 are then stripped from the floor slab 50. The fascia of the floor slab 50 is substantially co-planar with the exterior face 7 of the stem wall 5. The tabs 21 remain protruding from the exterior face 7 of the stem wall 5, while the extension member 20 remains firmly encased between the concrete of the floor slab 50 and the top of the stem wall 5.

Figure 5:
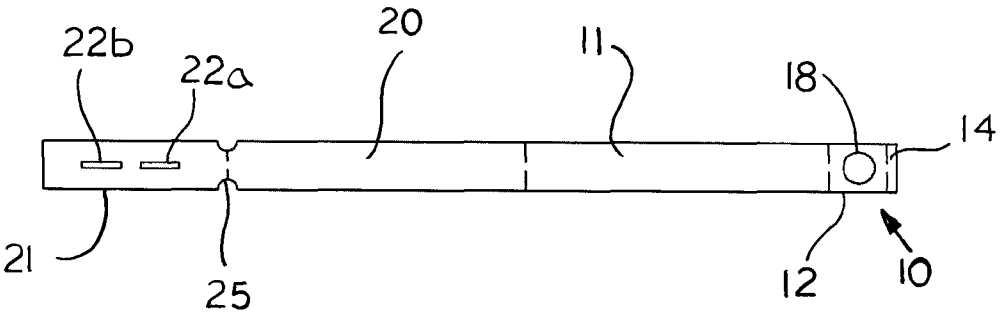
FIG. 5 is a top view of one embodiment of the tab member, extension member, and retaining member stamped out of a flat sheet of metal before being bent into proper form for installation.
Figure 7:
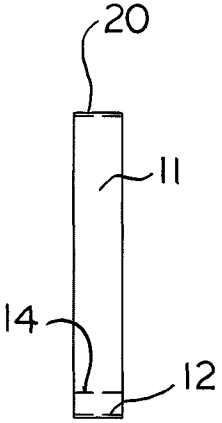
FIG. 7 is a rear view of one embodiment of the tab member, extension member, and retaining member bent into proper form for installation.
Figure 6:
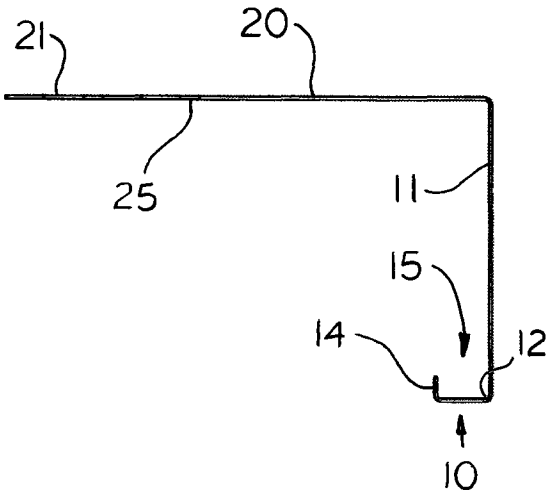
FIG. 6 is a flat view of one embodiment of the tab member, extension member, and retaining member bent into proper form for installation.

The tabs 21 are removed by one of several different methods. In one embodiment, the tabs 21 are removed by striking the tabs 21 with an impact force, which causes the tie assembly 1 to fracture at the release mechanism 25. This could be accomplished by striking the tabs 21 with a hammer or other impact tool. In this embodiment, the release mechanism 25 comprises a fracture zone area adapted to aid removal of the tab 21 from the extension member 20. For example, as shown in FIG. 5, one embodiment of the fracture zone area of the release mechanism 25 comprises one or more structural features to weaken the interface between the tab 21 and the extension member 20, such structural features including one or more of a neck, perforation, crease, slot, or other feature. In another embodiment, the release mechanism 25 could be a region between the tab 21 and the extension member 20 that is cut with a metal cutting tool, such as a bolt cutter, saw, or the like. In another embodiment, the release mechanism 25 is a hinge between the extension member 20 and the tab 21, and the release mechanism 25 is disengaged by removing the hinge pin from the hinge.

Referring again to FIG. 1, another embodiment of the retaining member 10 further comprises a lip 14 connected to the bend 12 at a location distal from the connection point of the shank 11, such that the gap between the shank 11 and the lip 14 forms a throat 15. This throat 15 is sized to snugly receive a wall of the header block 6, depending on the type of header block. In many applications, the header block 6 is a concrete masonry unit, such as a concrete block or cinder block, with one or more hollowed areas or cores, many of which are available in standard sizes. The throat 15 is sized such that an outside wall of one of these header blocks 6 is snugly seated in the throat 15. In this configuration, the lip 14 provides a greater anchoring force against pullout or uplift caused by the forces acting on the tie assembly 1, as described above.

Tie assemblies 1 are spaced along the length of the stem wall 5 as needed for the particular application. Typically, the tie assemblies 1 are spaced at intervals of a few feet on center. For ease of fabrication the lip 14, bend 12, shank 11, extension member 20 and tab 21 can be stamped out of a sheet or plate of metal. For example, the foregoing components can be stamped out of a sheet of metal having a thickness of 1/16 of an inch, 1/8 of an inch, or the like. The resulting metal strip is then cold formed by bending the strip at certain locations to form the foregoing components of the tie assembly 1. These components also could be made from plastic strips of appropriate dimensions.

Figure 10:
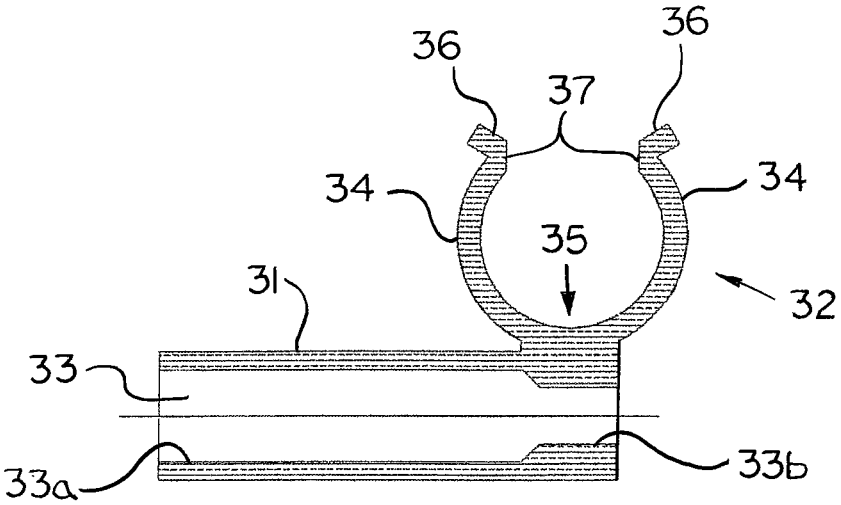
FIG. 10 is a cross section view of one embodiment of a reinforcement holder.
Figure 11:
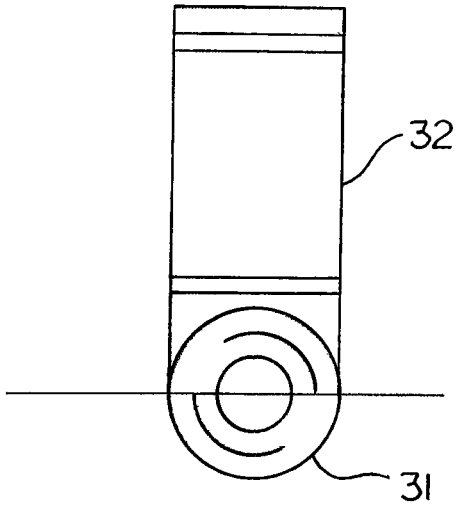
FIG. 11 is a side view of one embodiment of a reinforcement holder.

In another embodiment, referring to FIGS. 9-11, the tie assembly 1 further comprises a reinforcement holder 30 configured to attach to the mechanical fastener 27 in a manner that supports the reinforcing member 28. The reinforcement holder 30 is an optional member placed over the mechanical fasteners 27 prior to placement of the reinforcing members 28. The reinforcement holder 30 comprises a shaft 31 for receiving the mechanical fastener 27, and a clip member 32 for connecting to the reinforcing member 28. In one embodiment, the shaft 31 comprises a hollow recess 33 for receiving the mechanical fastener 27, where the hollow recess 33 has a portion with a first diameter 33*a* and a portion with a second diameter 33*b*. In one embodiment, the first diameter 33*a* is larger than that of the diameter of the mechanical fastener 27, and the second diameter 33*b* is slightly smaller than the diameter of the mechanical fastener 27. The reinforcement holder 30 is placed over the mechanical fastener 27 such that the recess 33 receives the tip 40 of the mechanical fastener 27. The mechanical fastener 27 passes through the recess 33 portion with the first diameter 33*a* with relative ease since there is no appreciable friction between the reinforcement holder 30 and the mechanical fastener 27. The tip 40 of the mechanical fastener 27 is then inserted into the recess 33 portion having the second diameter 33*b*, forming a snug fit between the reinforcement holder 30 and the mechanical fastener 27.

The reinforcement holder 30 is pressed over the mechanical fastener 27 until the mouth of the recess 33 contacts the form member 24, as shown in FIG. 9. In one embodiment, the shaft 31 is sized such that when the reinforcement holder 30 is in contact with the form member 24, the clip member 32 retains the reinforcing member 28 at a predetermined distance from the form member 24 such that the floor slab 50 will have an adequate cover over the reinforcing member 28. In this embodiment, the reinforcing member 28 is the edge reinforcing of the floor slab 50, and the cover distance is typically about one and one half to about two inches, although other cover distances could be used as well. In this embodiment, the reinforcement holder 30 functions to greatly increase the speed and ease of construction. The reinforcement holder 30 is quickly and easily placed over the mechanical fastener 27 and pressed until contact with the form member 24 occurs. The reinforcing member 28 is then placed in the clip member 32, and no other steps are needed to place the edge reinforcing at a proper distance from the form member 24. Since the length of the shaft 31 is pre-measured, the installing personnel does not have to spend time measuring the distance between the reinforcing member 28 and the form member 24 to ensure adequate cover distances.

In one embodiment, the clip member 32 comprises one or more retaining arms 34 defining a cradle 35 for seating the reinforcing member 28. In one embodiment, retaining arms 34 are flexible, curved members such that the ends of the retaining arms 34 define a neck 37 above the cradle 35. The ends of the retaining arms 34 comprise outwardly protruding lips 36 for receiving the reinforcing member 28. The reinforcing member 28 has a diameter greater than the width of the neck 37. As the reinforcing member 28 is forced toward the cradle 35, the reinforcing member 28 abuts the lips 36, thus forcing the retaining arms 34 to flex in an outward direction, thereby widening the neck 37. When the widest part of the reinforcing member 34 passes the neck 37, the reinforcing member 28 snaps into the cradle 35, the retaining arms 34 return to their original unflexed position, and the reinforcing member 28 is snugly seated in the cradle 35 and retained by the retaining arms 34.

The foregoing embodiments are merely representative of the tie assembly and not meant for limitation of the invention. For example, persons skilled in the art would appreciate that there are several embodiments and configurations of the tie assembly components, and other components will not substantially alter the nature of the system. Likewise, elements and features of the disclosed embodiments could be substituted or interchanged with elements and features of other embodiments, as will be appreciated by an ordinary practitioner. Consequently, it is understood that equivalents and substitutions for certain elements and components set forth above are part of the invention described herein, and the true scope of the invention is set forth in the claims below.

I claim:

1. A tie assembly for connecting forms for cast-in-place concrete floor slabs to masonry stem walls, the tie assembly comprising:

a retaining member configured to securely anchor to a stem wall;

an elongate extension member having a first end and a second end, the first end connected to the retaining member;

a tab connected to the second end of the extension member by a release mechanism, the tab having one or more slots for receiving a wedge stake, the wedge stake having a lower portion and an upper portion, the lower portion configured for insertion into one of the one or more slots of the tab and the upper portion configured for connection to the concrete form by a mechanical fastener having a tip; and a reinforcement holder having a shaft and a clip member, the shaft attached to the tip of the mechanical fastener, and the clip member configured to receivably retain a concrete reinforcing member;

wherein the shaft of the reinforcement holder comprises a hollow recess for receiving the tip of the mechanical fastener, where the hollow recess has a first portion with a first diameter and a second portion with a second diameter, where the first diameter is larger than the diameter of the mechanical fastener, and the second diameter is slightly smaller than the diameter of the mechanical fastener such that the second portion is configured to snugly receive the tip of the mechanical fastener.

2. The tie assembly of claim 1, wherein the clip member comprises one or more retaining arms defining a cradle for seating the reinforcing member.

3. The tie assembly of claim 1, wherein the retaining member comprises a shank and a lip disposed to define a throat sized to snugly receive a wall of a header block of the stem wall.

4. The tie assembly of claim 1, wherein the release mechanism comprises a fracture zone area disposed between the tab and the extension member, the fracture zone area including one or more structural features for weakening the interface between the tab and the extension member.

5. The tie assembly of claim 1, wherein the tab comprises a first receiving slot and a second receiving slot, wherein the first receiving slot is disposed in the tab at a location closer to the release mechanism that the location of the second receiving slot.

6. The tie assembly of claim 2, wherein the release mechanism comprises a fracture zone area disposed between the tab and the extension member, the fracture zone area including one or more structural features for weakening the interface between the tab and the extension member.

7. A tie assembly for connecting forms for cast-in-place concrete floor slabs to masonry stem walls, the tie assembly comprising:

a wedge stake having a wedge-like lower portion and an upper portion configured to receivably mate with a mechanical fastener having a tip;

a retaining member;

an elongate extension member having a first end connected to the retaining member, and a second end connected to a tab by a release mechanism, the tab having one or more slots for removably receiving the lower portion of the wedge stake; and a reinforcement holder having a shaft and a clip member, the shaft having a hollow recess for snugly receiving the tip of the mechanical fastener, and the clip member configured for receivably retaining a concrete reinforcing member.

8. The tie assembly of claim 7, wherein the shaft of the reinforcement holder comprises a hollow recess for receiving the tip of the mechanical fastener, where the hollow recess has a first portion with a first diameter and a second portion with a second diameter, where the first diameter is larger than the diameter of the mechanical fastener, and the second diameter is slightly smaller than the diameter of the mechanical fastener such that the second portion is configured to snugly receive the tip of the mechanical fastener.

9. The tie assembly of claim 7, wherein the clip member comprises one or more retaining arms defining a cradle for seating the reinforcing member.

10. The tie assembly of claim 7, wherein the retaining member comprises a shank and a lip disposed to define a throat sized to snugly receive a wall of a header block of the stem wall.

11. The tie assembly of claim 7, wherein the release mechanism comprises a fracture zone area disposed between the tab and the extension member, the fracture zone area including one or more structural features for weakening the interface between the tab and the extension member.

12. The tie assembly of claim 7, wherein the tab comprises a first receiving slot and a second receiving slot, wherein the first receiving slot is disposed in the tab at a location closer to the release mechanism that the location of the second receiving slot.

13. The tie assembly of claim 8, wherein the clip member comprises one or more retaining arms defining a cradle for seating the reinforcing member.

14. The tie assembly of claim 9, wherein the shaft of the reinforcement holder comprises a hollow recess for receiving the tip of the mechanical fastener, where the hollow recess has a first portion with a first diameter and a second portion with a second diameter, where the first diameter is larger than the diameter of the mechanical fastener, and the second diameter is slightly smaller than the diameter of the mechanical fastener such that the second portion is configured to snugly receive the tip of the mechanical fastener.

15. The tie assembly of claim 9, wherein the release mechanism comprises a fracture zone area disposed between the tab and the extension member, the fracture zone area including one or more structural features for weakening the interface between the tab and the extension member.

* * * * *